US005569064A

United States Patent [19]

Gleadall

[11] Patent Number: 5,569,064

[45] Date of Patent: Oct. 29, 1996

[54] TOOL FOR REFURBISHING SKATE BLADES

[75] Inventor: Jeffrey Gleadall, Stratford, Canada

[73] Assignee: Rinkratz International Inc., Ontario, Canada

[21] Appl. No.: 464,539

[22] Filed: Jun. 5, 1995

[51] Int. Cl.[6] ..... B24D 15/06

[52] U.S. Cl. ..... 451/558; 76/83; 76/88

[58] Field of Search ..... 451/558, 557; 76/83, 82, 86, 88

[56] References Cited

U.S. PATENT DOCUMENTS

| | | | |
|---|---|---|---|
| 471,164 | 3/1892 | Young . | |
| 1,301,801 | 4/1919 | Adams . | |
| 1,722,400 | 7/1929 | Stevens . | |
| 1,969,611 | 8/1934 | Jessen | 451/557 |
| 2,092,831 | 9/1937 | Cannon | 451/558 |
| 2,398,566 | 4/1946 | Talbert . | |
| 2,654,194 | 10/1953 | Raab . | |
| 3,585,880 | 6/1971 | Kabriel | 451/558 |
| 4,815,240 | 3/1989 | Larson | 451/558 |
| 5,239,785 | 8/1993 | Allen | 76/83 |
| 5,445,050 | 8/1995 | Owens | 76/83 |

FOREIGN PATENT DOCUMENTS

| | | | |
|---|---|---|---|
| 640472 | 5/1962 | Canada . | |
| 0158902 | 2/1933 | Switzerland | 76/83 |
| 0605743 | 7/1948 | United Kingdom | 451/557 |

*Primary Examiner*—Robert A. Rose

*Attorney, Agent, or Firm*—Gifford, Krass, Groh, Sprinkle, Patmore, Anderson & Citkowski, P.C.

[57] ABSTRACT

A refurbishing tool for renewing edges on a skate blade, including a pair of rigid, generally rectangular supporting members pivotably connected to each other. Each member has a flat abrasive surface on one side thereof and extending in the lengthwise direction of the supporting member. The abrasive surfaces are able to face each other during use of the tool. Preferably an integral plastic hinge pivotably connects the two members which can be arranged on opposite sides of a skate blade with the abrasive surfaces parallel to each other and engaging the sides of the blade. The tool is moved back and forth in a lengthwise direction to renew or recreate the edges.

19 Claims, 2 Drawing Sheets

TOOL FOR REFURBISHING SKATE BLADES

BACKGROUND OF THE INVENTION

This invention relates to devices or tools for manually sharpening or renewing the blade of a skate.

It is a well known fact that ice skates have blades which must be kept sharp in order for the skate to work properly and smoothly and in order to permit the user to skate quickly. Most regular skaters, including hockey players, recreational skaters and figures skaters will have their skates sharpened frequently possibly every time that the skates are used with the actual frequency of sharpening depending upon the length of use of the skates each time and the manner of use. Professional hockey players may sharpen their skates as often as three times per game.

Various methods and devices have been proposed for sharpening skate blades. Commonly, the bottom edge of a skate blade is ground using a fast rotating abrasive wheel with the wheel generally being driven by a motor. After the edge has been sharpened with such a wheel, it is common practice to use an oilstone with aluminum oxide or carborundum cutting granules to smooth and clean the sides of the blade.

Various portable or handheld skate sharpening devices have been proposed in the past. For example, recent U.S. Pat. No. 5,239,785 issued Aug. 31, 1993 to R. H. Allen describes a finishing tool having a pair of slots disposed along opposing faces. Disposed within each slot is a strip of leather material which can be secured therein by adhesive or fasteners. This holder is sized and dimensioned so that it can be handheld and readily manipulated during finishing of a skate blade. The top face of the holder has an angled portion with another strip of leather thereon, this strip being used to facilitate finishing the side faces of the blade. According to this patent specification, the leather strip can be used to remove foreign material deposited by the skate sharpening process and small burrs remaining on the blade surface. It will be appreciated that this patent specification describes a stropping tool and not a skate sharpener.

U.S. Pat. No. 3,585,880 issued Jun. 22, 1971 to B. Kabriel describes an ice skate sharpening tool having a generally T-shaped body with cross arms and a stem. Extending the length of the stem is a longitudinal slot which is undercut along one side to permit one side of the stem to flex in order to accommodate different skate blades. A central opening or recess in this tool receives two carbide cutting inserts which are the same size and shape. These inserts are rectangular and provide eight cutting edges for sharpening purposes. The inserts are positioned at right angles to one another and are transverse of and perpendicular to the longitudinal axis of the slot. With this device the skate must be turned to sharpen both sides of the blade.

U.S. Pat. No. 4,815,240 issued Mar. 28, 1989 to C. M. Larson describes a handheld skate sharpener with first and second exposed slots located in opposite sides thereof. The single sharpening element in this tool has a generally convex surface exposed within the first slot which is used to sharpen the bottom edge of the blade and has a generally flat surface exposed in the second slot so that the tool can also be used as a deburring device for removing burrs from opposed walls of the blade. However, with this device only one wall or side of the blade can be deburred at a time.

It is an object of the present invention to provide an inexpensive, easy to use tool for renewing, recreating or refurbishing edges on a skate blade and the opposing sides of the blade.

It is a further object of the present invention to provide a tool for renewing both edges or sides of a skate blade at the same time, which tool can be used between the usual skate sharpening sessions employing a fast rotating aluminum oxide or silicone carbide wheel.

SUMMARY OF THE INVENTION

According to one aspect of the invention, a tool for renewing cutting edges on a skate blade comprises a pair of rigid, generally rectangular supporting members, each having a flat abrasive surface on one side thereof and extending in the lengthwise direction of the supporting member. The abrasive surfaces of the two members are able to face each other in a parallel manner during use of this tool. A living hinge mechanism pivotably connects the supporting members along lengthwise edges thereof. The hinge mechanism comprises at least one thin strip of plastic having a thickness substantially less than the thickness of each supporting member. During use of the tool on a skate blade, the supporting members can be arranged on opposite sides of the blade with the abrasive surfaces substantially parallel to each other and engaging sides of the blade. The tool is moved back and forth in lengthwise direction of the supporting members to renew the edges of the blade.

In a preferred version of the tool, the two abrasive surfaces each extend substantially the entire length of their respective supporting member. The abrasive surface can be formed by an abrasive coated tape bonded to its respective supporting member.

According to another aspect of the invention, a tool for renewing cutting edges on a skate blade comprises a pair of supporting plates each with inner and outer sides with each inner side having a substantially flat, elongate supporting surface. An abrasive coated strip of tape extends in a lengthwise direction along each supporting surface and is bonded thereto. A hinge arrangement pivotably connects the supporting plates at adjacent edges thereof. A pivot axis formed by the hinge arrangement extends in the direction of the strips of tape. The hinge arrangement includes at least one thin strip of flexible plastic integrally connected to the supporting plates and having a thickness substantially less than the thickness of each supporting plate. The supporting members can be arranged on opposite sides of the blade with the two supporting surfaces substantially parallel to each other and facing each other.

Preferably the hinge arrangement is a triple living hinge made of a suitable plastics material and forming three pivot axes.

Further features and advantages will become apparent from the following detailed description taken in conjunction with the drawings.

DETAILED DESCRIPTION OF PREFERRED EMBODIMENTS

Figure 1:
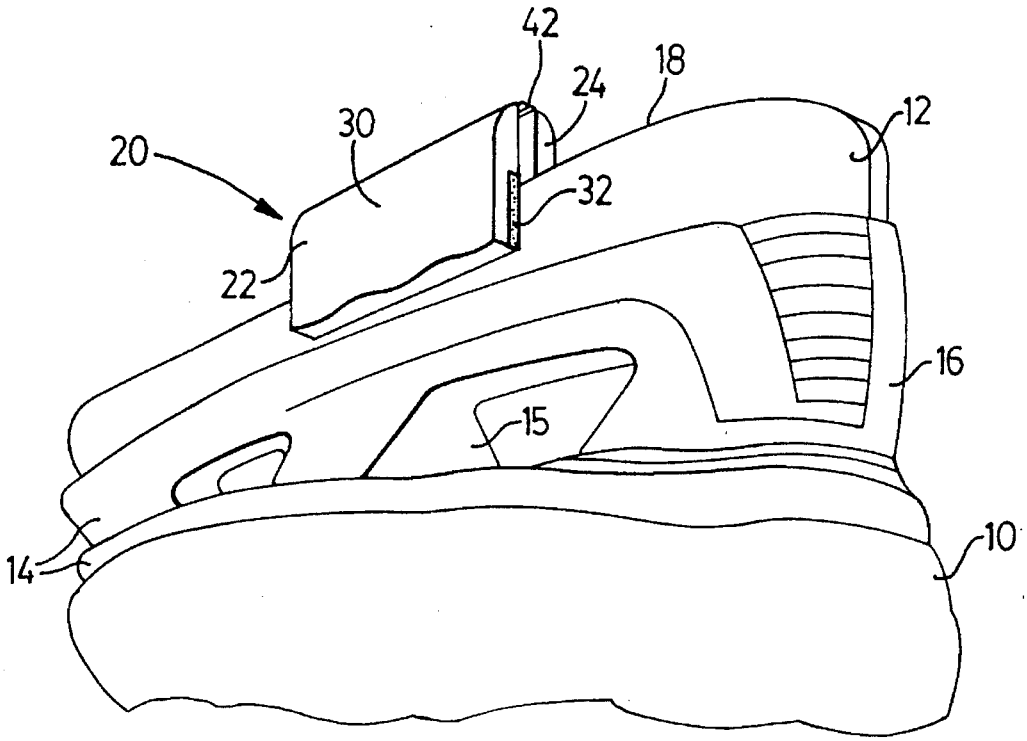
FIG. 1 is a perspective view of the bottom portion of an ice skate with a tool of the invention being positioned on its blade.

The bottom portion of a typical ice skate is illustrated in FIG. 1. The skate 10 is shown upside down as this is typically the position that it would be in when one is using the tool of the present invention. The skate comes with a steel blade 12 which extends from blade supporting members 14 to 16. As indicated, the bottom edge 18 of the blade, which is generally concave in transverse cross-section, must be kept sharp by reasonably frequent sharpening operations. Typically, the sharpening process is carried out using a fast rotating grinding wheel or disk designed for this purpose. The refurbishing tool 20 is not intended to replace the standard skate sharpener comprising such a grinding wheel but is for the purpose of keeping the double edge of the blade 12 sharp between the wheel grinding sharpening operation. By the use of the tool 20, the frequency of skate sharpening using a high speed grinding tool can be reduced. It should be appreciated that as the skates are used, the bottom of the steel blade 12 tends to get pushed out and therefore wider. In other words, the blade loses its edges as a result of usage. Use of the present tool 20 will quickly and efficiently reduce the edge 18 of the skate to its proper width and will help to recreate the edges on both sides of the blade so that they are sharp. Prior art tools used for this purpose, such as a standard oilstone, can only be used on one side of the blade at a time while this is not the case with the tool 20 of the present invention. The present tool 20 is also easy to use requiring very little, if any, training of the user in order to be handled properly. The preferred embodiment of the tool will fit different blade thicknesses due to the use of a flexible hinge that adjusts to the thickness of the skate blade.

The tool 20 includes a pair of rigid, generally rectangular supporting members 22 and 24, each having a flat abrasive surface 26 on an inner side thereof. The supporting members or plates each have an inner side 28 and an outer side 30. Each inner side 28 has a substantially flat, elongate supporting surface 32 and it is on this supporting surface that the aforementioned abrasive surface 26 is formed or provided. Each abrasive surface 26 extends in a lengthwise direction of its supporting member. In the configuration and arrangement shown in FIGS. 1 and 4, that is the configuration in which the tool is used, the abrasive surfaces 26 face each other. In a preferred form of the tool, the abrasive surface is provided by an abrasive coated strip of tape 40 that is bonded to its respective supporting member. Abrasive coated tape with a pressure sensitive adhesive on one side is per se known and therefore the construction and manufacture of such tape need not be described herein. The tape can be coated with abrasive carbides or it can be coated with small diamond particles.

Figure 2:
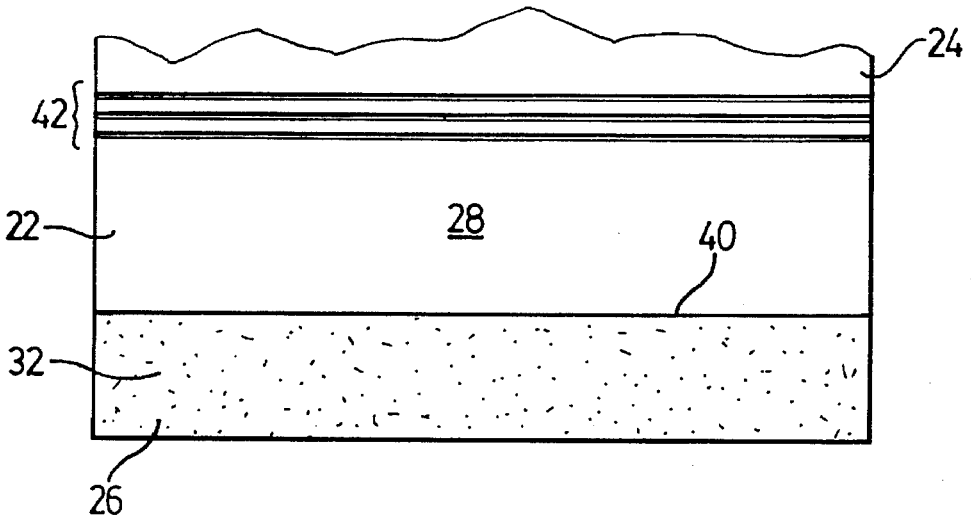
FIG. 2 is a side view of an inner side of one of the supporting plates of the tool.
Figure 3:
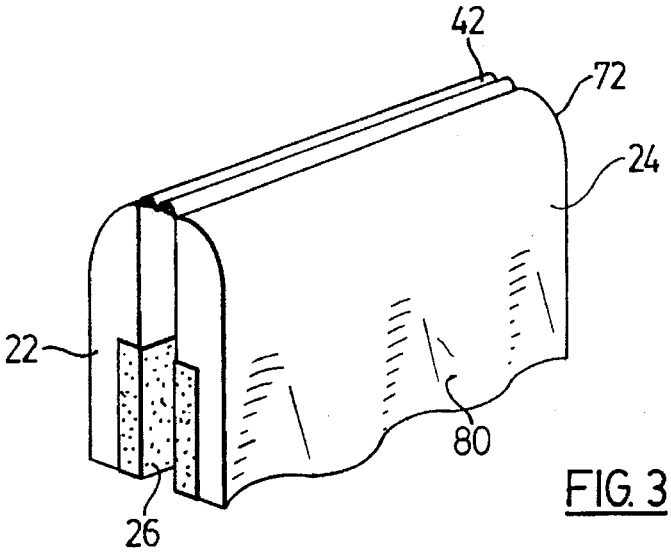
FIG. 3 is a perspective view showing one side and one end of the preferred tool of the invention with contoured exterior surfaces.
Figure 4:
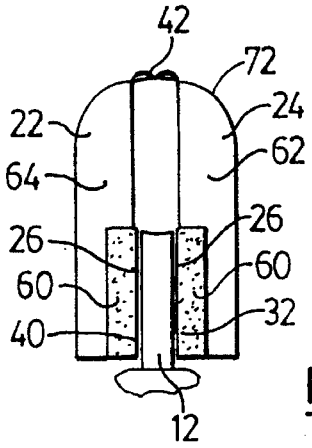
FIG. 4 is an end view of the tool shown in FIG. 1.
Figure 5:
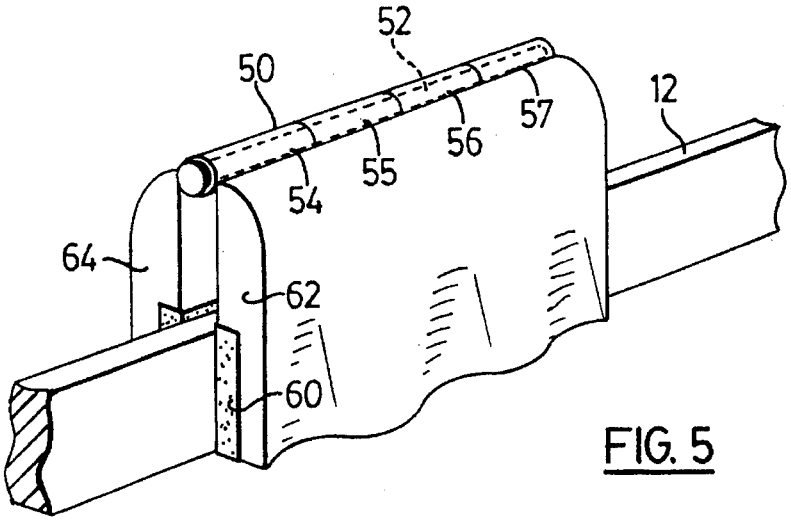
FIG. 5 is a perspective view of another version of the tool being used along a skate blade.

A hinge arrangement or mechanism 42 is used to pivotably connect the supporting members or plates along adjacent lengthwise edges thereof. As illustrated in FIGS. 2, 3 and 5, the hinge mechanism arrangement can extend substantially the length of the supporting members, thus ensuring that the hinge is relatively strong and holds the supporting plates correctly relative to one another. One preferred form of hinge is a triple "living" hinge comprising three thin strips of a suitable flexible plastic such as polypropylene but a single living hinge could also be used. As shown in FIGS. 3 and 4, the thin plastic strip forming each living hinge has a thickness which is substantially less than the thickness of the supporting plates. Because of the thinness and flexibility of these strips, the supporting plates are able to pivot easily relative to each other. These strips form three pivot axes. A thicker band of plastic joins each outer strip to the center strip of the hinge arrangement 42. With this hinge, the abrasive surfaces of the tool remain parallel to the sides of the blade as shown in FIG. 4 whatever the thickness of the blade may be. With the use of such a hinge, supporting members 22 and 24 are generally made from the same polypropylene material and are integrally connected to the hinge 42. Of course, a standard hinge 50 as shown in FIG. 5 can also be used. The hinge 50 includes a hinge pin 52 that extends substantially the length of the supporting members. It will be understood that the hinge pin extends through circular passageways formed in hinge sleeves 54 to 57 that can be formed along one long edge of the supporting members.

It will be appreciated that the supporting members 22 and 24 can be made of a variety of materials and not just a plastics material. For example, other possible materials are inexpensive metals, such as steel and aluminum and wood.

The tool of the invention is designed to be used in the manner shown in FIGS. 1, 4 and 5. The supporting members or plates 22 and 24 are arranged on opposite sides of the blade 12 with their abrasive surfaces in contact with these sides. In this position, the abrasive surfaces 26 are held substantially parallel to each other which is important from the standpoint of developing proper edges on the blade. With the tool in this position, it is moved back and forth in the lengthwise direction of the supporting members (which is also the lengthwise direction of the blade 12) to renew the edges of the blade.

Although not essential, it is preferred that the abrasive surfaces 26 or the tape strips extend substantially the entire length of the respective supporting member. In this way, a maximum amount of abrasive action can be applied to each side of the blade for a given size or length of tool. A short end portion 60 of the tape can extend around each end of the support plate and be adhered to plate end 62 or 64.

It will be appreciated that each type of hinge mechanism 42 or 50 forms at least one pivot axis which extends in the direction of the strips of tape 40.

Also, as shown in FIGS. 3 and 4, in the preferred version of the tool, the outer sides of the support members or plates can be rounded at 72 in the region of the hinge 42. This helps to reduce the amount of plastic required for the tool and may make the tool easier to hold. Also, the outer side of each supporting plate 22, 24 preferably has a contoured finger gripping surface indicated at 80. This surface comprises several rounded ridges alternating with recesses that accommodate the fingers and/or thumb of a user. This contoured surface helps to ensure a secure grip on the tool while it is being moved back and forth.

It will be apparent to those skilled in the art of skate sharpening and skate refurbishing that various modifications and changes could be made to the tool 20 as described herein without departing from the spirit and scope of this invention. For example, instead of using abrasive coated tapes on the supporting members, one could employ two elongate, flat sided abrasive stones embedded in or otherwise held in the two supporting members so that their opposing abrasive surfaces are parallel when the tool is being used. All such modifications and changes as fall within the scope of the appended claims are intended to be part of this invention.

I therefore claim:

1. A tool for renewing cutting edges on a skate blade comprising a pair of rigid, generally rectangular supporting members, each having a flat abrasive surface on one side thereof and extending in the lengthwise direction of the supporting member, the abrasive surfaces of the two members being able to face each other in a parallel manner, and a living hinge mechanism pivotally connecting said supporting members along adjacent lengthwise edges thereof, said hinge mechanism comprising at least one thin strip of plastic having a thickness substantially less than the thickness of each supporting member, wherein during use of said tool on a skate blade, said supporting members can be arranged on opposite sides of the blade with said abrasive surfaces substantially parallel to each other and engaging the sides of the blade and said tool is moved back and forth in the lengthwise direction of said supporting members to renew the edges of the blade.

2. A tool according to claim 1 wherein said abrasive surfaces each extend substantially the entire length of the respective supporting member.

3. A tool according to claim 1 wherein each abrasive surface is formed by an abrasive coated tape bonded to its respective supporting member.

4. A tool according to claim 3 wherein each supporting member comprises a generally flat block made of rigid plastics material.

5. A tool according to claim 2 wherein said living hinge mechanism extends substantially the length of said support members.

6. A tool according to claim 1 wherein said hinge mechanism comprises a triple living hinge having three pivot axes.

7. A tool for renewing cutting edges on a skate blade comprising a pair of rigid, generally rectangular supporting members, each having a flat abrasive surface on one side thereof and extending in the lengthwise direction of the supporting member, the abrasive surfaces of the two members being able to face each other, and a hinge mechanism pivotally connecting said supporting members along adjacent lengthwise edges thereof, said hinge mechanism including a hinge pin extending substantially the length of said supporting members, wherein during use of said tool on a skate blade, said supporting members can be arranged on opposite sides of the blade with said abrasive surfaces substantially parallel to each other and engaging the sides of the blade and said tool is moved back and forth in the lengthwise direction of said supporting members to renew the edges of the blade.

8. A tool according to claim 6 wherein said hinge mechanism comprises thin strips of flexible polypropylene plastic and said supporting members are also made of polypropylene and are integrally connected to said thin strips.

9. A tool according to claim 3 wherein said tape is coated with abrasive carbide particles.

10. A tool according to claim 9 wherein said tape is coated with diamond particles.

11. A tool according to claim 6 wherein a contoured finger gripping surface is formed on an exterior surface of each supporting member.

12. A tool for renewing cutting edges on a skate blade comprising a pair of supporting plates each with inner and outer sides, each inner side having a substantially flat, elongate supporting surface, an abrasive coated strip of tape extending in the lengthwise direction along each supporting surface and bonded thereto, and a hinge arrangement pivotally connecting said supporting plates at adjacent edges thereof, a pivot axis formed by said hinge arrangement extending in the direction of the strips of tape, said hinge arrangement including at least one thin strip of flexible plastic integrally connected to said supporting plates and having a thickness substantially less than the thickness of each supporting plate, wherein during use of the tool, said supporting plates can be arranged on opposite sides of the blade with the two supporting surfaces substantially parallel to each other and facing each other.

13. A tool according to claim 12 wherein said supporting plates are made of the same plastics material as said at least one strip of flexible plastic.

14. A tool according to claim 13 wherein said strips of tape are coated with diamond particles.

15. A tool according to claim 13 wherein each strip of tape extends from one end of its respective supporting plate to an opposite end thereof.

16. A tool according to claim 12 wherein said hinge arrangement comprises a triple living hinge having three pivot axes.

17. A tool according to claim 16 wherein a contoured finger gripping surface is formed on said outer side of each supporting plate.

18. A tool according to claim 17 wherein said hinge arrangement comprises thin strips of flexible polypropylene plastic and said supporting plates are also made of polypropylene.

19. A tool according to claim 17 wherein said strips of tape are diamond coated.

* * * * *